US005483249A

United States Patent [19]

Kennedy

[11] Patent Number: 5,483,249

[45] Date of Patent: Jan. 9, 1996

[54] TUNABLE CIRCUIT BOARD ANTENNA

[75] Inventor: John F. Kennedy, Dearborn, Mich.

[73] Assignee: Ford Motor Company, Dearborn, Mich.

[21] Appl. No.: 503,961

[22] Filed: Jul. 19, 1995

Related U.S. Application Data

[63] Continuation of Ser. No. 130,936, Oct. 4, 1993, abandoned.

[51] Int. Cl.[6] ..... H01Q 1/38

[52] U.S. Cl. ..... 343/846; 343/700 MS; 343/848

[58] Field of Search ..... 343/846, 700 MS, 343/848, 829, 828, 831; 29/600; H01Q 1/38

[56] References Cited

U.S. PATENT DOCUMENTS

| | | | |
|---|---|---|---|
| 4,040,060 | 8/1977 | Kaloi | 343/700 MS |
| 4,078,237 | 3/1978 | Kaloi | 343/700 MS |
| 4,095,227 | 6/1978 | Kaloi | 343/700 MS |
| 4,130,822 | 12/1978 | Conroy | 343/700 MS |
| 4,367,474 | 1/1983 | Schaubert et al. | 343/700 MS |
| 4,429,313 | 1/1984 | Muhs, Jr. et al. | 343/771 |
| 4,587,524 | 5/1986 | Hall | 343/729 |
| 4,625,185 | 11/1986 | Burzi et al. | 333/204 |
| 4,701,763 | 10/1987 | Yamamoto et al. | 343/700 MS |
| 5,041,838 | 8/1991 | Liimatainen et al. | 343/700 MS |
| 5,173,711 | 12/1992 | Takeuchi et al. | 343/700 MS |
| 5,241,322 | 10/1993 | Gegan | 343/700 MS |

*Primary Examiner*—Donald T. Hajec
*Assistant Examiner*—Hoanganh Le
*Attorney, Agent, or Firm*—Kevin G. Mierzwa; Roger L. May

[57] ABSTRACT

An antenna is provided on a circuit board which has an elongated stub, having an end connected through the dielectric circuit board to a ground plane. The combination of the ground plane, stub and dielectric forms a resonant cavity. The resonant frequency of the cavity is adjustable by selectably sorting through holes provided in the end of the stub opposite to where the reference ground plane is connected to the stub.

4 Claims, 1 Drawing Sheet

TUNABLE CIRCUIT BOARD ANTENNA

This is a continuation of application Ser. No. 08/130,936 filed Oct. 4, 1993 now abandoned.

INCORPORATION BY REFERENCE

The application is related to copending application entitled, "RF Sail Pumped Tuned Antenna", Ser. No. 08/130,933, which is commonly owned, filed simultaneously herewith and hereby incorporated by reference.

BACKGROUND OF THE INVENTION

The invention relates generally to antennas for receiving RF signals and more particularly to the tuning of a resonant cavity formed on a printed circuit board.

Some antennas formed on a circuit boards have a resonant cavity defined by a ground plane on one side of the circuit board, a formed piece of stripline referred to as a stub on the other side of the circuit board and an electrical connection between them. The shape and length of the stub determines the resonant frequency of the cavity. Generally, the stub is formed of stripline shaped on a circuit board. In order to tune these antennas, discrete components such as capacitors and inductors are used. For example, variable capacitors and variable inductors are used to tune the desired resonant frequency during the manufacturing process to compensate for manufacturing variability or substitutions of materials. However, variations in temperature such as that encountered by an automobile causes the characteristics of the discrete components to change, which in turn causes the resonant frequency of the antenna to drift.

It is desirable to retain some manufacturing flexibility in an antenna design. For instance, if certain materials of the circuit board are unavailable during the life cycle of the circuit board substitute materials may be used. This may cause the resonant frequency to shift. Consequently, it is desirable to compensate for any frequency shift to facilitate retaining component material flexibility.

SUMMARY OF THE INVENTION

The present invention advantageously eliminates the need for discrete components while still permitting precise adjustment of the resonant frequency of the antenna.

A preferred embodiment of the present invention includes a dielectric layer having a first side and a second side and an electrically conductive ground plane disposed on the first side. The invention further includes an elongated electrically conductive stub located on the second side having a first end and a second end. The first end is electrically connected to the ground plane (reference), whereby the stub, the dielectric layer and the ground plane form a resonant cavity having a resonant frequency. The stub has a plurality of tuning holes in the dielectric layer between the electrically conductive ground plane and the second end of the electrically conductive strip. The through holes are selectably filled with conductive material to obtain a desired resonant frequency.

DETAILED DESCRIPTION OF THE PREFERRED EMBODIMENT

Figure 1:
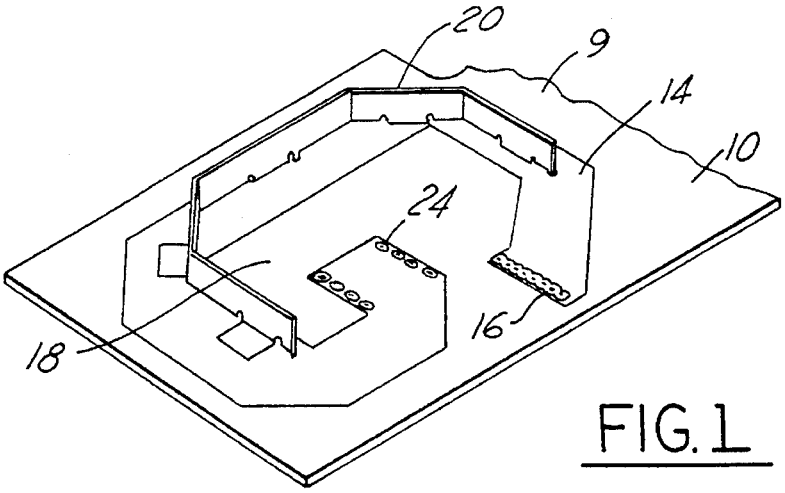
FIG. 1 is a perspective view of the preferred embodiment.
Figure 2:
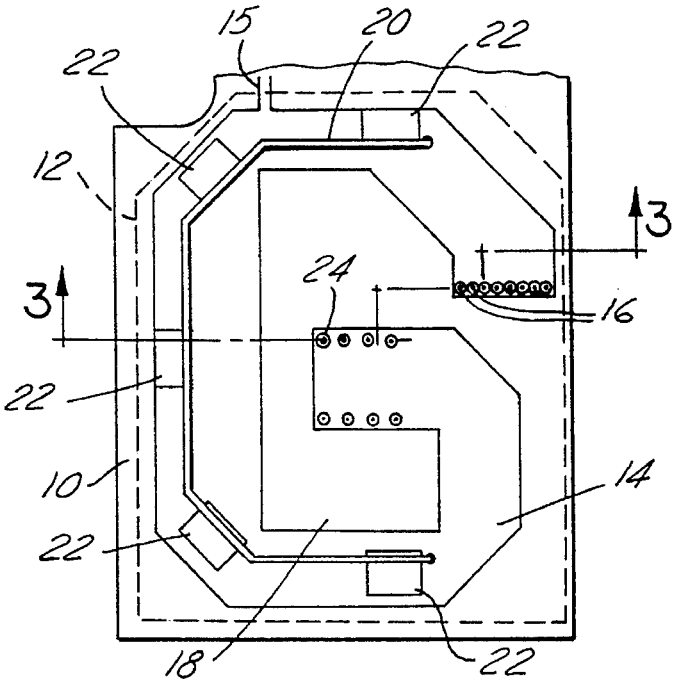
FIG. 2 is a top view of the preferred embodiment.
Figure 3:
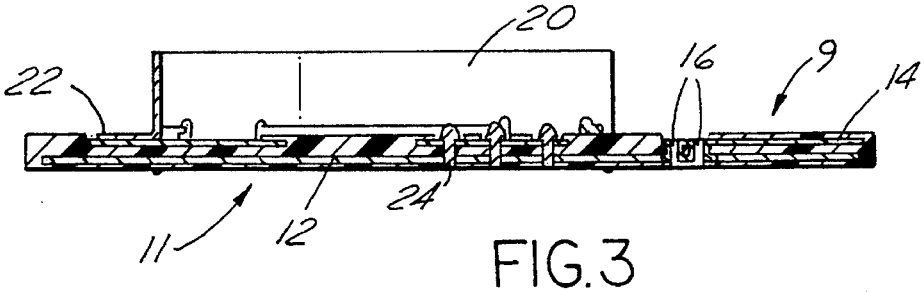
FIG. 3 is a cross sectional view of the preferred embodiment.

Referring to FIGS. 1–3, circuit board 10 has a top side 9 and a bottom side 11 each containing a conductive layer. FIG. 1 is a perspective view of the top side. The top conductive layer of circuit board 10 is a stub 14 which is formed in the metallic layer. Stub 14 is a continuous elongated strip having a width which is formed to substantially enclose an area on the top surface of circuit board 10. The preferred embodiment stub 14 is a "G" shape with a width which varies from about 0.5 inches to about 0.75 inches. Stub 14 is connected to receiver circuitry (not shown) through feed 15. Stub 14 is made of a conductive material such as stripline and can also be made of a material such as silver coated copper. The resonant frequencies of the preferred embodiment are in the order of several hundred MegaHertz. These high frequency signals travel on the outside boundaries of conductors such as stub 14. A highly conductive coating such as silver or copper on stub 14 is well suited to increase the "Q" value of the resonant frequency of the stripline.

The conductive layer on the bottom side 11 of circuit board 10 is a ground plane 12 comprised of a metallic layer of the same material. Ground plane 12 is sized to be at least as large as the area in the perimeter of stub 14. Ground plane 12 is electrically connected to a first end 26 of stub 14 by way of copper plated through holes 16 in a conventional manner. A second end 28 of stub 14 has a series of tuning holes 24 filled with conductive material through circuit board 10.

Ground plane 12, through holes 16, stub 14, and tuning holes 24 form a cavity 18 for resonating at a radio frequency from a received RF signal. Circuit board 10 acts as a dielectric between ground plane 12 and stub 14. Circuit board 10 is preferably made of commonly known material such as FR4. A dielectric material with an even more desirable higher dielectric constant such as aluminum oxide or teflon can be used. The resonant frequency of cavity 18 depends at least in part on the shape and length of stub 14. In a preferred embodiment, the resonant frequency of the antenna as shown was about 434 MHz with a bandwidth of 18 MHz.

A preferred embodiment employs six tuning holes 24. In order to change resonant frequency of cavity 18, holes 24 are selectably filled with solder or copper plating to electrically short stub 14 to ground plane 12. This changes the inductance and capacitance of the antenna cavity, thereby increasing the resonant frequency of the antenna. The amount of frequency change depends on several factors including the physical distance between the through holes 16 (i.e, ground reference) and tuning holes 24, the cavity shape, the dielectric constant of the material of circuit board 10, and the number of filled tuning holes, etc.

As the through holes are filled, the resonant frequency of cavity of 14 increases. In the preferred embodiment, the resonant frequency of the antenna is 202 MHz with no holes filled. As the next four tuning holes 24 are filled the frequency changes to about 395 MHz, 410 MHz, 415 MHz, and 433.92 MHz, respectively. As additional holes are filled, the step size of frequency change decreases.

The use of through holes 24 eliminates the need to provide an external tuning source such as a capacitor or other discrete components. The invention provides a means to compensate for variance in manufacturing processes. Furthermore, if different materials are substituted in manufacturing (e.g., a printed circuit board material having a different dielectric constant) which would change the resonant frequency, a different number of through holes can be filled to restore the resonant frequency.

In addition, stub 14 can also have a sail 20 as described in the disclosure incorporated by reference above. Sail 20 acts to increase the omnidirectionality of the antenna.

The RF antenna as described above is suitable for automotive applications because temperature sensitive discrete tuning components have been eliminated and the ground reference is consistent during the manufacturing process. The incorporation of such design into an antenna allows the manufacture of circuit boards with different materials whose frequency changes can be compensated by the number of filled tuning holes that are shorted to ground plane 12. Also, providing extra unshorted tuning holes allows adjustment of the resonant frequency during the manufacturing process. Various modifications will no doubt occur to those skilled in the art. For example, the shape and length of antenna can be varied to change the frequency of the antenna as described above without varying from the scope of the invention.

What is claimed is:

1. A frequency tunable closed cavity antenna for receiving a RF signal comprising:

a dielectric layer having a first side and a second side;

an electrically conductive ground plane disposed on said first side;

an elongated electrically conductive stub located on said second side having a first end, a second end, and a length said stub substantially enclosing a predetermined area on said second side of said dielectric layer, said first end and second end having a predetermined distance therebetween, said distance being shorter than said length, said first end electrically connected to said ground plane, said stub, said dielectric layer and ground plane forming a resonant cavity having a resonant frequency; and a plurality of tuning holes in said dielectric layer between said electrically conductive ground plane and said second end of said electrically conductive stub closing said resonant cavity, said tuning holes being selectably filled with conductive material to obtain a predetermined resonant frequency of the resonant cavity.

2. An antenna as recited in claim 1 wherein said tuning holes are each located at a respective distance from said first end.

3. An antenna as recited in claim 1 wherein the shape of said stub is a G shape.

4. A frequency tunable closed cavity antenna for receiving a RF signal comprising:

a dielectric layer having a first side and a second side;

an electrically conductive ground plane having an inductance disposed on said first side;

an elongated electrically conductive stub located on said second side having a first end, a second end and a length, said stub substantially enclosing a predetermined area on said second side of said dielectric layer so that said first end of said stub and second end of said stub have a predetermined distance therebetween, said predetermined distance shorter than said length; and a plurality of tuning holes in said dielectric layer between said electrically conductive ground plane and said second end of said electrically conductive stub, at least one of said tuning holes being selectably filled with conductive material, said dielectric layer and said ground plane forming a resonant cavity having a resonant frequency, a first end and a second end, said first end of said stub electrically connected to said ground plane to close said first end of said resonant cavity, at least one of said tuning holes filled to close said second end of said resonant cavity to define a cavity length, at least one additional tuning hole filled to change said inductance of said ground plane to obtain a desired resonant frequency of said resonant cavity.

* * * * *